US007458702B2

(12) United States Patent
Versluijs et al.

(10) Patent No.: US 7,458,702 B2
(45) Date of Patent: Dec. 2, 2008

(54) LOCKING ELEMENT HOLDS SCREENING CAP IN LIGHTING UNIT

(75) Inventors: Cornelis Versluijs, Eindhoven (NL); Mark Josephus Lucien Maria Van Dommelen, Turnhout (BE); Gert Jansen, Turnhout (BE)

(73) Assignee: Koninlijke Philips Electronics N.V., Eindhoven (NL)

( * ) Notice: Subject to any disclaimer, the term of this patent is extended or adjusted under 35 U.S.C. 154(b) by 33 days.

(21) Appl. No.: 10/535,293

(22) PCT Filed: Nov. 4, 2003

(86) PCT No.: PCT/IB03/05034

§ 371 (c)(1),
(2), (4) Date: May 17, 2005

(87) PCT Pub. No.: WO2004/046609

PCT Pub. Date: Jun. 3, 2004

(65) Prior Publication Data

US 2006/0072321 A1 Apr. 6, 2006

(30) Foreign Application Priority Data

Nov. 21, 2002 (EP) ..... 02079875.7

(51) Int. Cl.
*F21V 14/00* (2006.01)
*F21V 7/00* (2006.01)
*F21V 11/00* (2006.01)

(52) U.S. Cl. ..... 362/255; 362/303; 362/351

(58) Field of Classification Search ..... 362/303, 362/351, 330

See application file for complete search history.

(56) References Cited

U.S. PATENT DOCUMENTS

| | | | | |
|---|---|---|---|---|
| 2,277,563 | A * | 3/1942 | Scott et al. | 362/298 |
| 5,001,387 | A * | 3/1991 | van der Heijden | 313/25 |
| 5,506,464 | A * | 4/1996 | Ooms | 362/306 |
| 6,382,816 | B1 * | 5/2002 | Zhao et al. | 362/310 |

FOREIGN PATENT DOCUMENTS

EP 0 336 478 A1 10/1989

OTHER PUBLICATIONS http://www.google.com/search?sourceid=navclient&aq=t&ie=UTF-8&rls=GGLD,GGLD:2004-30,GGLD:en&q=define%3aadhesion.*
http://www.google.com/search?sourceid=navclient&aq=t&ie=UTF-8&rls=GGLD,GGLD:2004-30,GGLD:en&q=define%3abond.*
http://en.wikipedia.org/wiki/Metal_halide_lamp & http://wordnet.princeton.edu/perl/webwn?s=cap.*
http://wordnet.princeton.edu/perl/webwn?s=interlock.*

* cited by examiner

*Primary Examiner*—Sandra O'Shea
*Assistant Examiner*—William J Carter

(57) ABSTRACT

The invention relates to a lighting unit having a concave reflector with an axis of symmetry and a light emission window bounded by a circumferential edge transverse to the axis, an elongate light source extending substantially along the axis of symmetry, which light source is accommodated in a holder opposite the light emission window, and an axially positioned cap, which cap partly surrounds the light source and forms an optical means to intercept unreflected light rays. According to the invention, the light source is surrounded by a sleeve with an end at the side of the light emission window, over which end the cap is positioned by way of a fixing element.

7 Claims, 4 Drawing Sheets

LOCKING ELEMENT HOLDS SCREENING CAP IN LIGHTING UNIT

Figure 1:
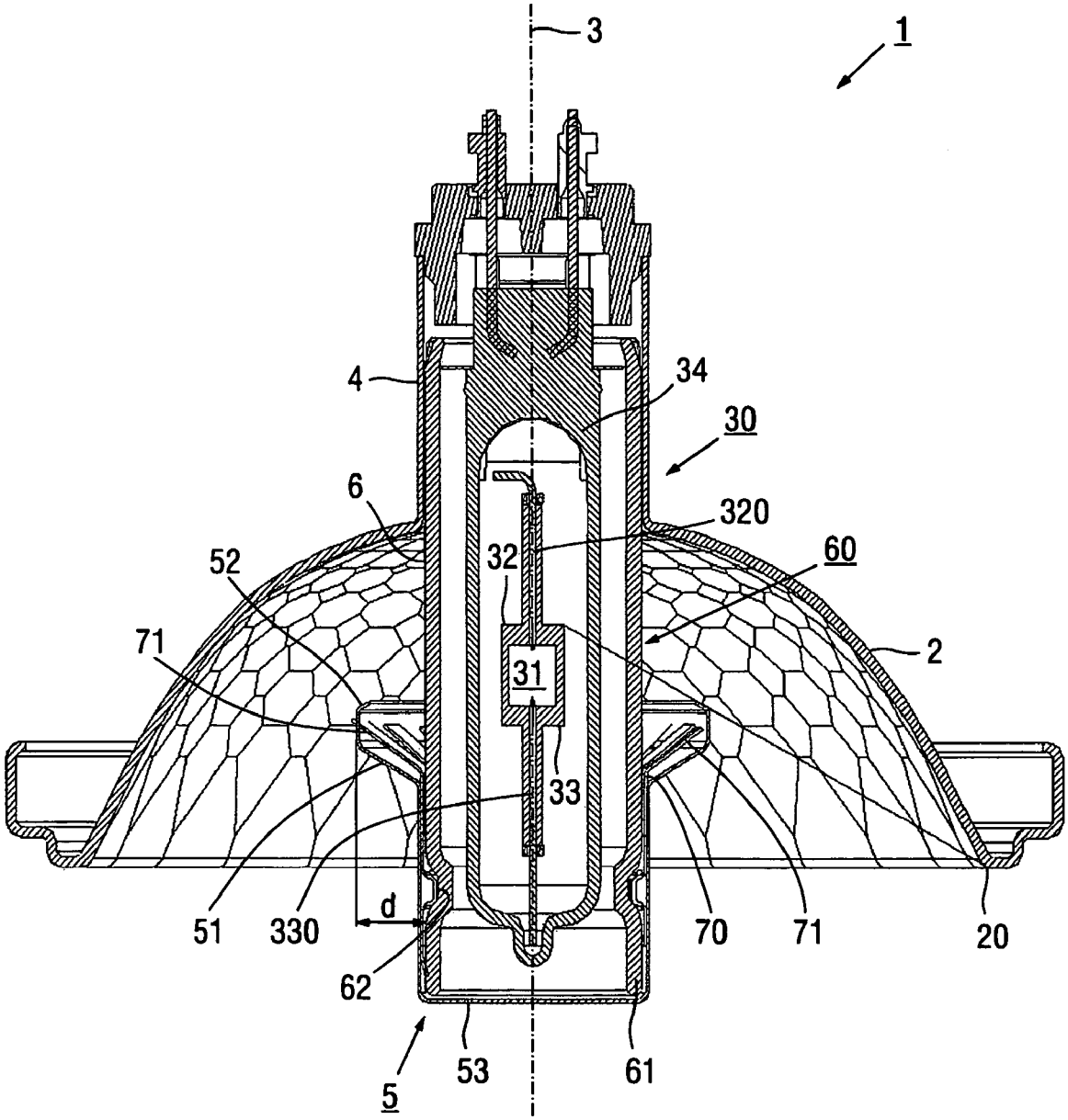

The invention relates to a lighting unit provided with a concave reflector having an axis of symmetry and a light emission window bounded by a circumferential edge of the reflector that is transverse to said axis, an elongate body arranged substantially axially on the axis of symmetry and accommodated in a holder opposite the light emission window, an axially positioned cap serving as an optical screening means which surrounds the light source at least partly so as to intercept unreflected light rays.

Such a lighting unit is known from EP 0336478. The light source is provided with an outer bulb. A cap which is impermeable to light is provided on the outer bulb at the side facing the light emission window. Keeping the impermeable cap in place is a problem because a direct connection between the cap and the outer bulb is exposed to major stresses owing to the large temperature differences that occur. This often leads to a failure of the connection in practice, so that the position of the cap in question is no longer guaranteed. The problem identified above is the more serious if the light source is realized by means of a high-pressure discharge. A cap formed by a thin-walled metal bush which is passed with clamping fit over the outer bulb is found to be not reliably positioned either because of the thermal stresses. Fastening of the cap to the reflector by means of radial fastening arms has the drawback that said fastening arms intercept reflected light and thus interfere with the light beam formed by the reflector.

The invention has for its object to provide a solution to the above problem such that the drawbacks mentioned are eliminated. According to the invention, the lighting unit is for this purpose characterized in that the light source is surrounded by a sleeve having an end facing the light emission window, and the cap is positioned over the sleeve adjacent said end by means of a locking element provided at the sleeve. A sleeve is known per se as a protection means for the eventuality of an explosion of the lamp vessel. There is a risk of the discharge vessel exploding in particular in the case of a high-pressure discharge. The sleeve is preferably formed from glass that is resistant to temperatures of at least 600° C. such as hard glass, quartz glass, and quartz, and is fastened to the reflector at the area of the holder. The sleeve is provided with the cap with a cooperating locking element at the area of an end of the sleeve. The fastening of the sleeve to the reflector at the area of the holder achieves that no light reflected by the reflector is intercepted. Also, the reflector is at such a distance from the light source that thermal stresses are considerably reduced. This is yet enhanced in a preferred embodiment in which the reflector is manufactured from metal, for example aluminum. Such a reflector promotes heat transport and accordingly temperature equalization.

The locking element is preferably provided at the sleeve by means of clamping, preferably resilient clamping. It is advantageous in this respect if at least one recess is provided in an outer surface of the sleeve with which a portion of the locking element engages.

In an advantageous embodiment of the lighting unit, the cap is provided with a screening ring at the side facing away from the light emission window, which ring is impermeable to light and extends radially away from the light source over a distance d. The positioning of the screening ring renders it possible to prevent an emission of unreflected light in an effective manner, i.e. of that light that originates from the portion of the light source situated between the cap and the holder. By giving the locking element a suitable shape, it is possible to lock the cap over the end of the sleeve by means of the screening ring.

Preferably, the screening ring is provided with a ring edge facing towards the light source, and the locking element is provided with a tag-shaped element that grips into the ring edge with spring force radially away from the light source. The cap may then be readily mounted in that the cap is passed over the end of the sleeve and over the locking element provided thereon until the ring edge of the screening ring grips over the tag-shaped element. The cap is then locked against a return movement with respect to the sleeve. To ensure that the cap is fixed in a defined position relative to the light source, the cap is preferably provided with means that bear on a portion of the sleeve designed for this purpose. An advantageous embodiment is that the cap bears on the end of the sleeve, for example in that the cap is provided with a bottom surface at the side of the light emission window. In an alternative embodiment, the cap is largely open at the side of the light emission window and provided with at least one shaped portion that is radially directed towards the light source and that bears on the end of the sleeve. If the cap is provided with a bottom surface, the sleeve may be open at its end without this leading to increased risks in the case of a light source explosion. If the cap is open for the major part at the side of the light emission window, however, it is preferable for the sleeve to be closed at its end.

In an alternative embodiment, the locking element with one portion enters a mating recess in the sleeve while at the same time being enclosed with another portion in a mating locking holder of the cap. Preferably, the locking element is shaped such that it grips with spring force into the respective recess in the sleeve on the one hand, and on the other hand bears with spring force on the locking holder.

The light source may be formed by an incandescent body, for example an incandescent coil, or by a discharge generated in a discharge vessel. Preferred suitable discharges are high-pressure sodium discharges and metal halide discharges. The discharge vessel is preferably formed from ceramic material in both cases, by which are meant in the present description and claims sapphire, densely sintered polycrystalline metal oxide, for example aluminum oxide, and densely sintered aluminum nitride. Very compact light sources can be manufactured by means of these discharges on account of their high luminous efficacy, which sources in their turn are highly suitable for realizing compact dimensions in the lighting unit according to the invention in combination with favorable beam properties. A metal halide light source here has the favorable properties that very good color characteristics can be realized and that it has a long life.

In a further advantageous embodiment, the holder is provided with an electrical connection contact for connecting an electrical supply source.

The reflector and the light source are preferably indetachably integrated into a lamp, for example by means of connections to the holder.

Preferably, the holder is provided with a locking mechanism adjacent a connection to the light source and the sleeve. This mechanism is preferably formed such that the coupling between holder and reflector on the one hand and between light source and sleeve on the other hand is maintained in spite of differences in expansion of the light source during operation. The locking mechanism in an advantageous embodiment is formed by an indentation adjacent an end of the holder. Very suitable is an arrangement in which three indentations are provided at mutually equal distances on the circumference of the relevant end of the holder.

The lighting unit is advantageously provided with a ceramic base which is connected to the light source by means of cement, such that the cement forms an interlocking agent.

Figure 2A:
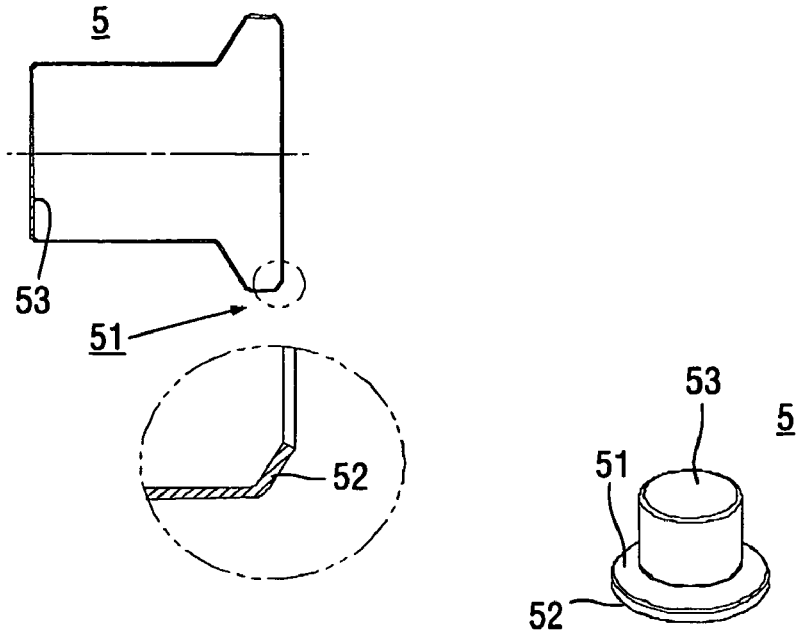
Figure 4:
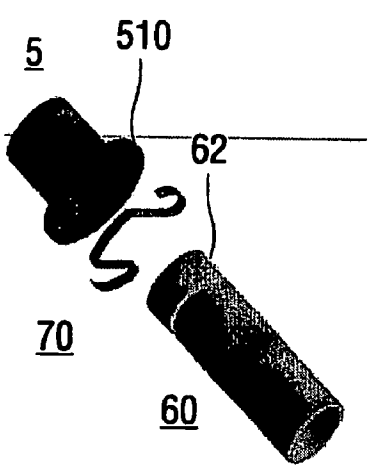
Figure 5:
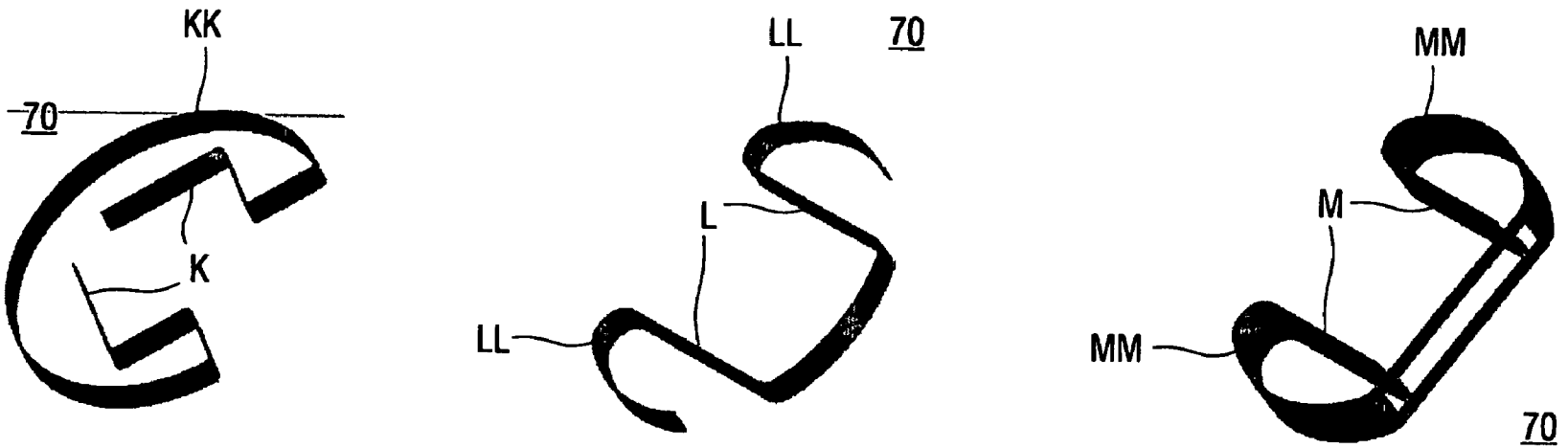
Figure 5:
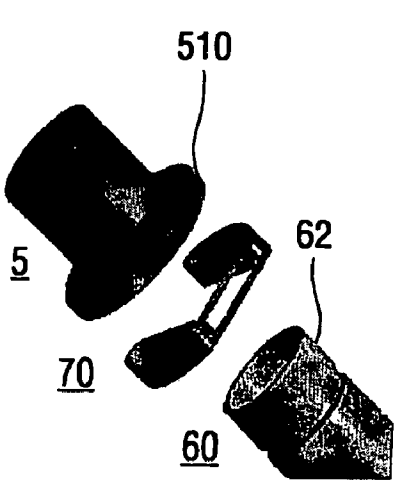
Figure 6:
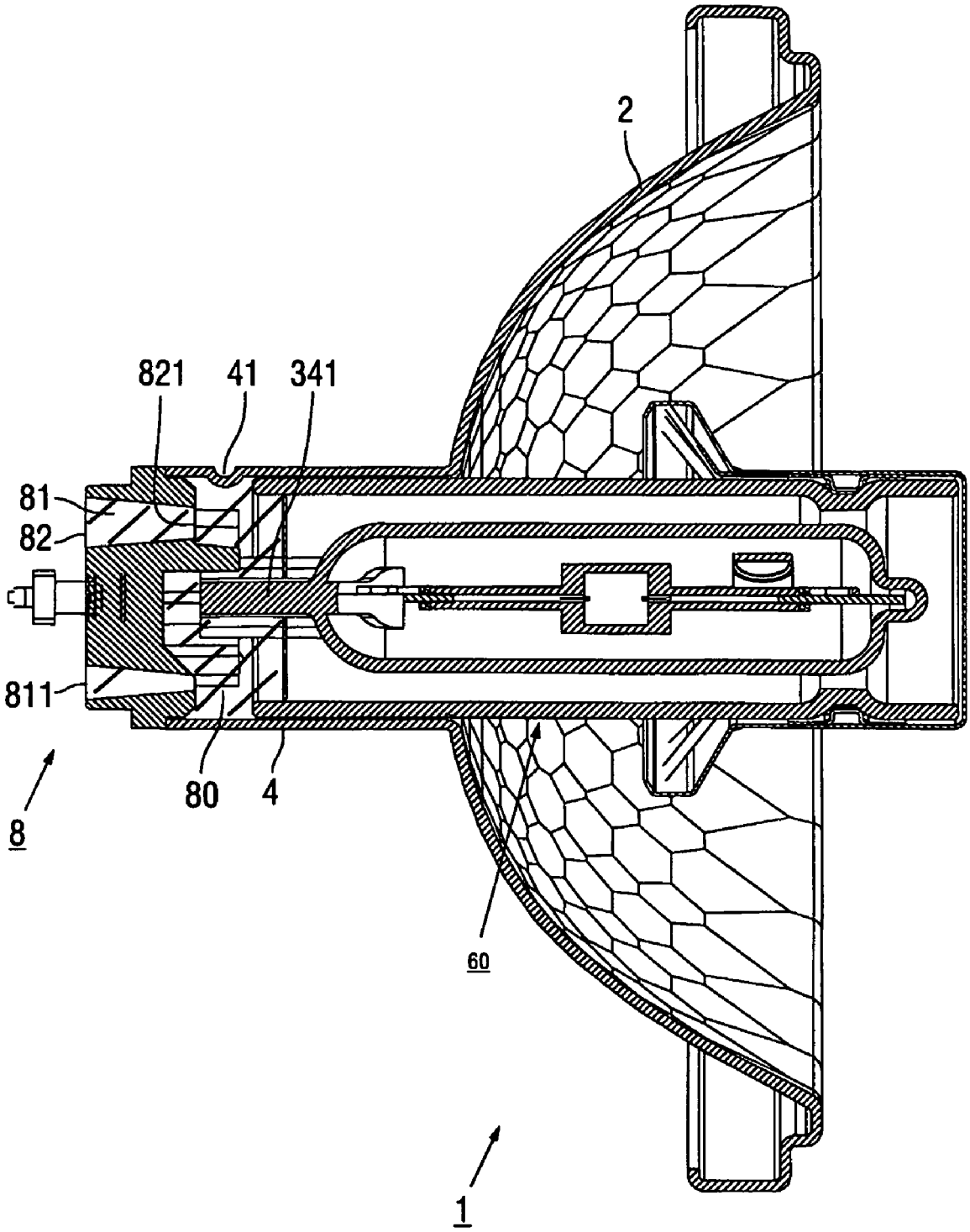

The above and further aspects of the invention will be explained in more detail below with reference to a drawing, in which:

FIG. 1 is a cross-sectional view of a lighting unit according to the invention, FIGS. 2A and B are elevations of the cap and the locking element for use in the lighting unit of FIG. 1, FIGS. 3, 4, and 5 are alternative forms of the sleeve, cap, and locking element for use in the lighting unit, and FIG. 6 shows a further modification of the lighting unit according to the invention.

In FIG. 1, a lighting unit 1 is provided with a concave reflector 2 having an axis of symmetry 3 and a light emission window 21 bounded by a circumferential edge 20 of the reflector transverse to said axis, with an elongate light source 30 axially arranged substantially symmetrically on the axis of symmetry and accommodated in a holder 4 opposite the light emission window, and with an axially positioned cap 5 serving as an optical screening means that partly surrounds the light source for intercepting unreflected light rays. The light source is surrounded by a sleeve 60 having an end 61 that faces the light emission window. The cap 5 is positioned over the sleeve adjacent an end thereof by means of a locking element 70 provided at the sleeve. In the embodiment shown, the light source is formed by a ceramic discharge vessel 31 which is provided with external closing plugs 320, 330 at respective axial end faces 32, 33 for positioning lead-through elements to electrodes arranged in the discharge vessel, between which electrodes a discharge extends in the operational condition. This is a metal halide discharge in the example described. The discharge vessel is accommodated in an outer bulb 34. The outer bulb 34, sleeve 60, and reflector 2 are indetachably connected to one another at the area of the holder 4 in the case described. The reflector and the light source have thus been integrated into a metal halide lamp.

The sleeve 60 is a tubular body of hard glass over which the cap 5 has been passed at the area of the end 61. The cap is provided with a screening ring 51 at the side facing away from the light emission window, which ring extends radially away from the light source over a distance d. The positioning of the screening ring effectively prevents an unreflected emission of light originating from that portion of the light source that is situated between the cap and the holder. The screening ring is provided with a ring edge 52, and the locking element 70 is provided with a tag-shaped element 71 that grips into the ring edge under spring force in a direction radially away from the light source. At least one recess 62 is provided in an outer surface 6 of the sleeve 60, into which a portion of the locking element 70 grips under spring force.

Figure 2B:
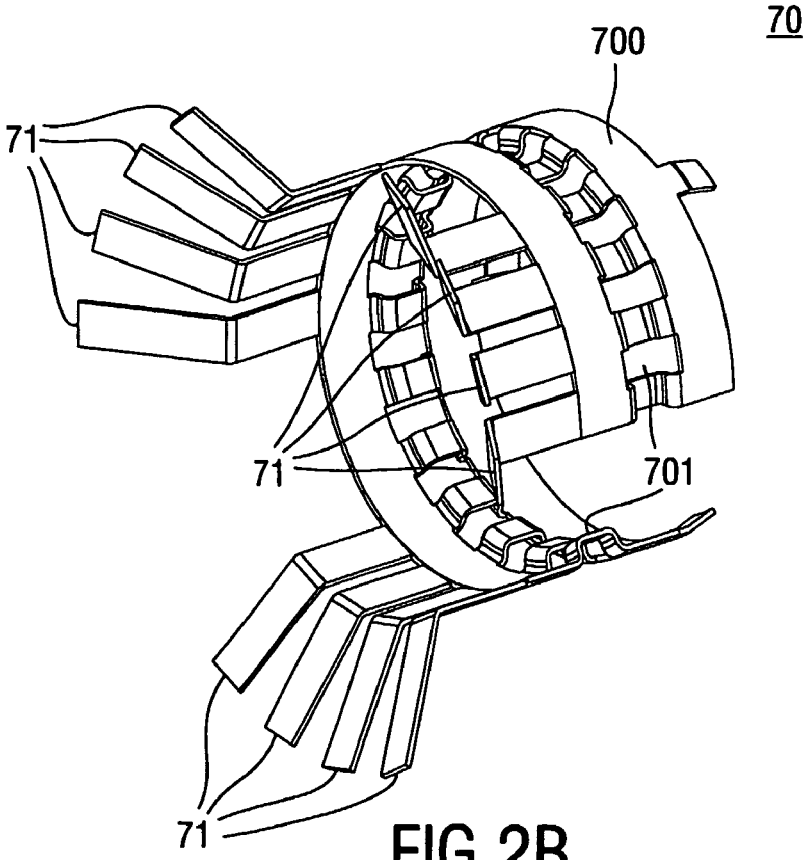

FIGS. 2A and B are separate views of the cap and the locking element according to the invention, respectively. FIG. 2A shows the cap 5 with the screening ring 51 both in perspective view and in cross-sectional view. The ring edge 52 is shown in detail in an insert in the latter view. The cap is provided with a bottom surface 53. FIG. 2B shows a suitable embodiment of the locking element 70 provided with tag-shaped elements 71 in perspective view. The locking element 70 is a circumferential resilient body 700 with a profile 701, to which three groups of four tag-shaped elements 71 each are connected at substantially the same mutual distances. In the mounted state, the profile 701 of the resilient body 700 will enter the mating recess 62 in the sleeve 60.

Figure 3:
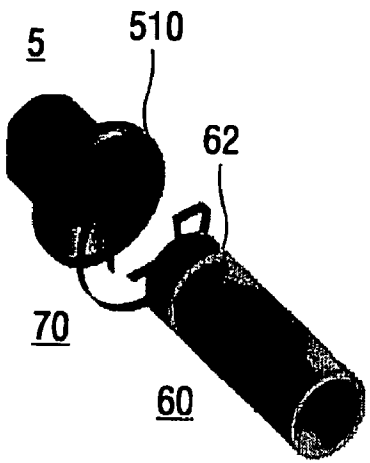

FIGS. 3, 4, and 5 are exploded views of different embodiments of locking elements for associated different embodiments of the sleeve, wherein the locking element 70 partly enters mating recesses 62 in the sleeve 60 with its segments K, L, M and at the same time is enclosed with other segments KK, LL, MM in associated locking holders 510 of the cap 5. The locking holder is preferably formed such that on the one hand it grips with spring pressure into the mating recess in the sleeve and on the other hand rests under spring force in the locking holder. In the embodiment shown, the locking holder 510 is formed as part of the screening ring 51 of the cap 5.

Although the segments K, L, M, and KK, LL, MM are situated in one plane in the embodiments shown, this need not necessarily be the case.

FIG. 6 shows a further advantageous embodiment in which the holder 4 is provided with a base 8 with electrical connection contacts for connecting an electrical supply source.

The reflector and the light source are preferably indetachably connected to one another so as to form a lamp, preferably at the area of the holder 4.

In FIG. 6, the holder 4 is provided with a locking mechanism 41 adjacent a connection to the light source 34 and the sleeve 60 in the form of an indentation close to an end of the holder 4. This indentation is shaped such that the coupling between the reflector on the one hand and the light source and sleeve on the other hand remains intact in spite of differences in expansion during operation of the light source. Very favorable is a situation in which three indentations 41 are provided at equal mutual distances on the circumference of the relevant end of the holder.

The base 8, holder 4 and sleeve 60 are joined to a seal 341, for example in the form of a pinch, of the light source by means of a cement 80. The base 8 is provided with a filling hole 81 and a rise hole 811 for providing the still liquid cement mass. In a manner known per se, the cement mass is cured by heating into cement 80, whereby the joint mentioned above is created. The choice of a filling circumference 82 for the filling hole 81 greater than an exit circumference 821 advantageously achieves that the cement 80 in the cured state forms an interlocking fixture. This is realized in the embodiment shown in that the filling hole 81 has a tapering gradient in cross-section. The interlocking effect is further enhanced in that the rise hole 811 also has a tapering gradient with a greatest diameter at the side remote from the holder 4.

The invention claimed is:

1. A lighting unit comprising a concave reflector having an axis of symmetry and a light emission window bounded by a circumferential edge of the reflector that is transverse to said axis, an elongate body arranged substantially axially on the axis of symmetry and accommodated in a holder opposite the light emission window, an axially positioned cap serving as an optical screening means which surrounds the a light source at least partly so as to intercept unreflected light rays, wherein the light source is surrounded by a sleeve having an end facing the light emission window, and the cap is positioned over the sleeve adjacent said end by means of a locking element provided at the sleeve, wherein the cap is provided with a screening ring having a ring edge facing towards the light source, and the locking element is provided with a tag-shaped element that grips into the ring edge with spring force radially away from the light source.

2. The lighting unit as claimed in claim 1, characterized in that the sleeve is provided with an outer surface in which at least one recess is present into which a portion of the locking element grips.

3. The lighting unit as claimed in claim 1, wherein the reflector and the light source are indetachably integrated into a lamp.

4. The lamp as claimed in claim 3, wherein the holder is provided with a locking mechanism adjacent a connection to the light source and the sleeve.

5. The lamp as claimed in claim 3, characterized in that the lamp is a metal halide lamp with a ceramic discharge vessel.

6. The lamp as claimed in claim 3, characterized in that the lamp is provided with a ceramic lamp base which is connected to the assembly of reflector and light source by means of cement, and in that said cement forms an interlocking fixture.

7. The unit of claim 1, wherein the locking element is a mechanical piece distinct from the sleeve and the cap.

* * * * *